US006557197B1

(12) United States Patent
Graham

(10) Patent No.: US 6,557,197 B1
(45) Date of Patent: May 6, 2003

(54) SUPPORT PILLOW FOR RECTAL SURGERY

(76) Inventor: Bruce D. Graham, 5655 W. 150th St., Overland Park, KS (US) 66223

( * ) Notice: Subject to any disclaimer, the term of this patent is extended or adjusted under 35 U.S.C. 154(b) by 0 days.

(21) Appl. No.: 09/999,092

(22) Filed: Nov. 1, 2001

(51) Int. Cl.[7] ..... A61G 13/12; A47G 9/00
(52) U.S. Cl. ..... 5/630; 5/632
(58) Field of Search ..... 5/630, 632, 652, 5/731, 732, 624; D6/601; 128/845

(56) References Cited

U.S. PATENT DOCUMENTS 3,811,140 A * 5/1974 Burpo ..... 5/630
4,398,707 A * 8/1983 Cloward ..... 5/632
4,579,111 A * 4/1986 Ledesma ..... 5/632
4,840,362 A * 6/1989 Bremer et al. ..... 5/632
4,923,187 A * 5/1990 Mombrinie ..... 5/630
5,239,716 A * 8/1993 Fisk ..... 5/630
D397,270 S * 8/1998 Maalouf ..... D6/601
6,065,166 A * 5/2000 Sharrock et al. ..... 5/630
6,125,487 A * 10/2000 Ive ..... 5/655
D438,046 S * 2/2001 Palm ..... D6/601

* cited by examiner

*Primary Examiner*—Alexander Grosz
(74) *Attorney, Agent, or Firm*—Hovey Williams LLP

(57) ABSTRACT

A surgical pillow is provided for supporting, cushioning and positioning a patient while in a prone position on an operating table during rectal surgery. The pillow comprises an elongated, self-sustaining, flexible body unit of compressible material having shape return memory. The body unit is provided with an indented upper face defined by a longitudinally extending, centrally located channel and chamfered downwardly inclined patient positioning surfaces on opposite sides of the central channel. Converging, inclined side surfaces of the body unit are configured and strategically located to accommodate the axilla areas of a patient while the patient is supported on the body unit. A removable cover that substantially conforms to the configuration of the body unit is provided in full covering relationship to the body unit.

17 Claims, 1 Drawing Sheet

SUPPORT PILLOW FOR RECTAL SURGERY

BACKGROUND

This invention relates to an improved surgical pillow especially adapted to support, cushion and position a patient while in a prone position on an operating table during rectal surgery.

At the present time, positioning of a patient for rectal surgery on a conventional operating table is most usually accomplished by making up rolls of blankets, towels or other similar items which are then placed along opposite sides of the patient's torso. That technique has many disadvantages including the tendency for the rolled support to shift and tend to be displaced from the original patient supporting locations thereof, and the fact that the rolls do not provide optimum patient cushioning and positioning. Furthermore, it is difficult to arrange the blanket or towel rolls in this position such that the patient's arms can be placed comfortably hanging over the edges of the operating table. Equally as significant, although support is provided by the rolls, blanket or towels for the patient's torso, the patient is still lying flat on the table in a prone positions such that pressure is inherently applied to the central part of the patient's body. The result is a tendency for the compressive forces on the patient's torso to impede veinous blood return to the patient's heart.

Efforts to solve the problem of providing comfortable and effective support and positioning of a patient in a prone position during rectal surgery have not found widespread acceptance and universal usage in part because of the complexity and cost of prior devices, the inability of the supporting devices to adequately accommodate patients of different sizes and weights, and the inordinate setup and adjustment time encountered with certain units.

PRIOR ART

U.S. Pat. No. 6,076,525 discloses a frame for supporting a patient in a prone position for surgery which includes a frame having longitudinal and lateral beams which support upright posts having pads on the upper extremities thereof. The posts are adjustable laterally and longitudinally of the beams for patients of different sizes. The frame assembly of the '525 patent not only requires extensive adjustment, but is also not intended to support a patient during rectal surgery, but instead is specifically designed to maintain a patient's back in an orthopedically preferred position for spinal surgery.

Similarly, U.S. Pat. No. 5,239,716 relates to a surgical spining positioning frame made up a multiplicity of parts for lateral, longitudinal and pivotal adjustment said to allow optimal patient positioning. A powered actuator is provided which serves to actuate flexible strips and pads to position the patient so that the curvature of the patient's spine may be adjusted to assure maximum lumbar access.

Another spinal surgery support is illustrated and described in U.S. Pat. No. 4,840,362 in which comprises a kit of resilient blocks interconnected by hoop and loop fasteners for securing the various blocks in desired positions. The blocks are shaped and dimensioned for different patient sizes and different curvatures of the patient's spine. The kit includes a base block, a U-shaped block, inside and outside filler blocks, face and chest blocks, and a pair each of flexion, lordosis, or neutral blocks. The nature of the surgical procedure and the size and shape of the patient are said to determine the size and identity of the blocks to be used.

U.S. Pat. No. 2,764,150 concerns a convex spinal frame in which the curvature of a main support panel which carries opposed rolls held in place by fastening belts or the like. The curvature of the main panel may be adjusted as desired by adjustment of a hand operated screw connected to links joined to respective opposite ends of the support panel.

U.S. Pat. No. 4,579,111 relates to a lumbar lamenectomy pad made up of two elongated two elongated pyramidally configured bolsters carried by a rectangular base cushion and associated with a headrest or pillow. The two side by side bolsters present a V-shaped cavity therebetween for receiving the torso of a patient. Arm restraints are provided on opposite sides of the triangularly configured bolsters.

The spinal surgery chest bolster assembly of U.S. Pat. No. 4,908,892 is made up of a chest support bolster which is used in conjunction with a separate triangular spinal surgery frame. The support bolster consists of a trapezoidal pillow having a central slot for receiving the patient's head and providing shoulder support.

An iliac support frame for a patient during back surgery as disclosed in U.S. Pat. No. 4,923,187 has two horizontally spaced, hemispherical pillows which have curved upper surfaces. The semi-circular upper surfaces of the opposed patient supporting pillows are said to better maintain a patient's vertebrae in desired curved, spaced relationship for X-ray examination. A somewhat similar spinal surgery frame having spaced curved upper surface supports is illustrated in U.S. Pat. No. 5,584,302.

A surgical pillow is illustrated in U.S. Pat. No. Des. 438,046, having a central planar portion with two elongated, spaced blocks positioned on the central portion. The construction of the pillow is unknown and the manner in which a patient is supported by the pillow cannot be discerned from the patent drawings. A pillow having a channel formed centrally therethrough is also illustrated in U.S. Pat. No. Des. 397,270.

SUMMARY OF THE INVENTION

An improved surgical pillow is provided for supporting and cushioning patients of different sizes and weights while the patient is in a prone position on an operating table during rectal surgery. The pillow comprises an elongated, self-sustaining body unit of compressible material having shape return memory. The body unit is provided with an indented upper face defined by a longitudinally extending, centrally located channel, and chamfered downwardly inclined surfaces on opposite sides of the central channel.

The pillow is designed to be placed on the flat surface of a conventional operating table used for rectal surgery in which the patient's torso rests in a prone position on the table, while that person's legs extend beyond the table and are supported by an L-shaped accessory component of the table. The chamfered inclined surfaces engage, cushion and cradle the patient's torso and maintain the patient in a centrally disposed position on the operating table during the operation. In addition, the pillow provides reproduceable positioning of different patients with variable body habitus. Patients are more secure on the operating table with less chance of fall. Jackknife positioning of a patient on the surgery table is avoided. Most importantly, improved veinous blood return through the central channel of the pillow is assured, thereby lessening risk of hypotension during the surgical procedure.

In particular, the body unit of the surgical pillow includes an elongated, generally rectangular base section which supports a pair of elongated, parallel, spaced, transversely polygonal torso support sections extending along the length of the base unit. The polygonal sections have inwardly facing, directly opposed chamfered surfaces which extend downwardly from the top walls of corresponding sections and that merge with respective upright, horizontally spaced inner walls of the sections which cooperate with the top surface of the base section to define the central channel through the body unit. End portions of the base section as well as corresponding ends of the polygonal sections are inclined relatively to define upright, outwardly diverging inclined surfaces on opposite sides of the base section in disposition to receive the upper ends of the patient's arms when the patient is cradled by the pillow.

The foam body unit is preferably provided with a removeable cover which generally conforms to the outer surface configuration of the pillow, thereby permitting the cover to be periodically sanitized independent of the body unit, and to be replaced if desired.

DESCRIPTION OF THE PREFERRED EMBODIMENT

Figure 1:
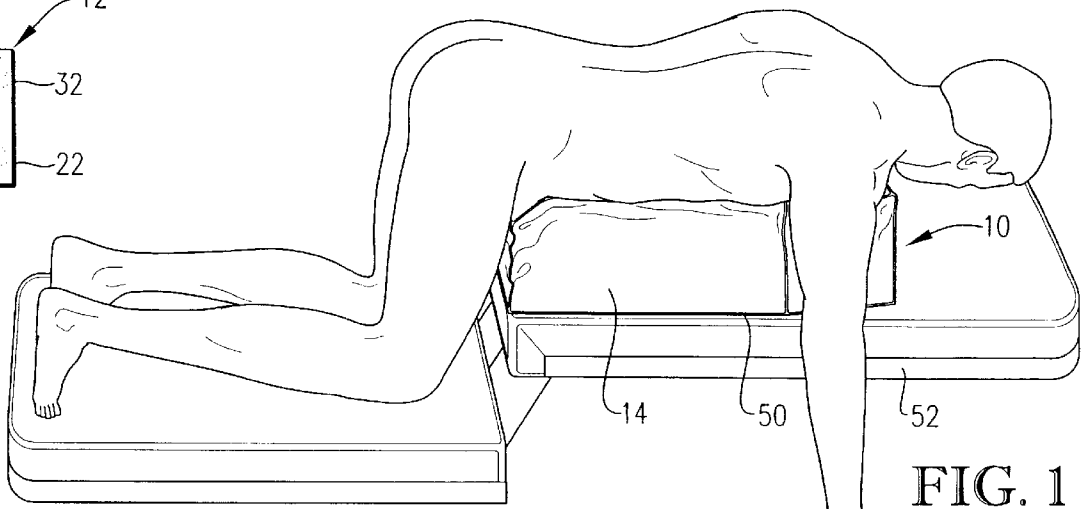
FIG. 1 is a respective representation of the improved pillow for rectal surgery schematically illustrating the manner in which a patient is cradled, cushioned and positioned by the pillow during surgery.
Figure 2:
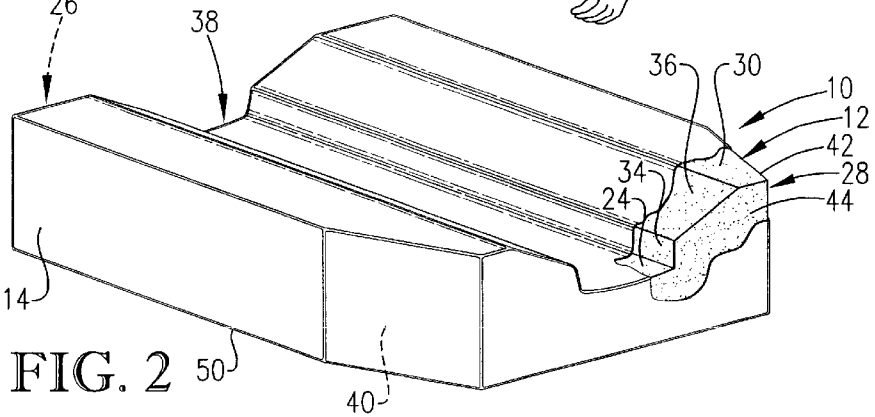
FIG. 2 is a respective view of the pillow with the cover being broken away to illustrate the underlying, self-sustaining, flexible and compressible body unit.

An improved pillow for rectal surgery is illustrated in the drawings and generally designated by the numeral 10. The elongated, self-sustaining, flexible, one-piece, monolithic, compressible foam body unit 12 of pillow 10 is normally contained within a removeable cover 14 that generally conforms to the surface configuration of body unit 12. The generally rectangular base section 16 of body unit 12 has a flat bottom surface 18, opposed upright side surfaces 20 and 22 and an upwardly facing top surface 24. Base section 16 supports two integral, elongated, transversely polygonal torso support sections 26 and 28 which project upwardly from the top surface 24 of base section 16. Each of the torso support sections 26 and 28 has a longitudinally extending top wall 30, an outer side wall 32, an upright, relatively short inner wall 34 and a respective chamfered wall 36.

Figure 3:
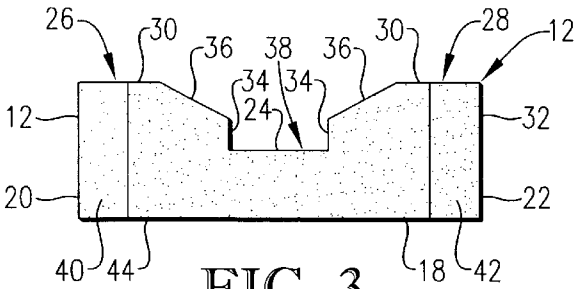
FIG. 3 is an end view of one end of the body unit of the pillow.
Figure 4:
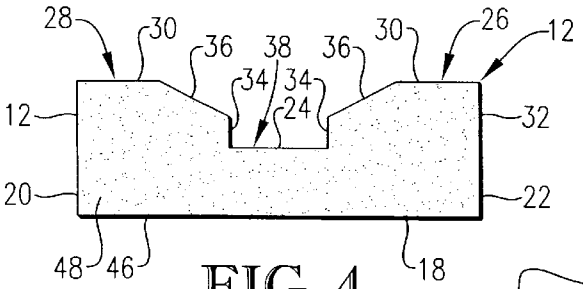
FIG. 4 is an end view of the opposite end of the body unit of the pillow.

It can be seen from FIGS. 3 and 4 that the opposed, horizontally spaced inner walls 34 of polygonal torso support sections 26 and 28 cooperate with the top surface 24 of base section 16 to define an elongated, centrally disposed channel 38 extending longitudinally of base section 16. Inclined chamfered walls 36 extend downwardly and inwardly at an angle of about 45° with respect to the horizontal from respective top walls 30 of torso support sections 26 and 28 and merge with the upper margins of respective inner walls 34.

The transverse width of channel 38 between opposed walls 34 of torso support sections 26 and 28 is approximately equal to one-fourth of the horizontal width of body unit 12 defined by side surfaces 20 and 22 and outer side walls 32 of base unit 12. The channel 38 is also of a depth approximately equal to the vertical height of a respective chamfered surface 36. The top wall 30 of each of the torso support section 26 and 28 is of a width approximately equal to the horizontal width of channel 38.

The side surfaces 20 and 22 of base sections 16 and the corresponding outer side walls 32 of torso support sections 26 and 28 have upright, inclined, converging surfaces 40 and 42 at one end 44 of body unit 12. The opposite end 46 of base unit 12 is defined by a flat upright surface 48.

Body unit 12 is preferably constructed of a compressible foam having shape return memory, which may be a synthetic resin or natural foam. Cover 14 is also preferably fabricated of a material which is liquid-proof and that may be subjected to repeated sanitizing procedures, as with chemical agents or the like, without significant deterioration. It is also to be understood that one of the margins 50, for example, which extends around a significant part of the perimeter of base unit 12 is defined by edges of the cover releasedly held together by hook and loop fastening devices.

The overall horizontal width of body unit 12 is related to and corresponds generally to the width of a patient's torso. The distance between and the angularity of chamfered wall surfaces 36 of torso support sections 26 and 28 and the corresponding width of channel 38, although correlated with a normal patient's body habitus, permits reproduceable positioning of patients with variable body habitus on an operating table. The channel 38 is of a width and depth allowing improved venous blood return to lessen the risk of patient hypotension during the surgical procedure.

In use of pillow 10, it is placed in desired position on the upper surface of an operating table 52 (shown schematically for illustration purposes only and not intended to be representative of an actual operating table), and a patient is situated in a prone position on the pillow. The patient's torso is cradled, cushioned and positioned by the chamfered surfaces of walls 36 of torso support sections 26 and 28 while providing improved exposure of the patient for the rectal surgery.

It can also be seen from FIG. 1, that when a patient is positioned properly on pillow 10, that patient's arms may hang freely over opposite sides of the operating table 52 in view of the relief provided by inclined upright surfaces 40 and 42 of body unit 12. In addition, a head supporting pillow or other supporting cushion may be provided under the patient's head in a desired location adjacent end 44 of pillow 10.

I claim as my invention:

1. An improved surgical pillow for supporting and cushioning a patient's body while the patient is in a prone position on an operating table during rectal surgery, said pillow comprising:

a body unit of compressible material having shape return memory, said body unit including an elongated, generally rectangular base section provided with opposed end portions defining normally upright end surfaces, opposed generally upright, side surfaces extending between the end surfaces, a relatively flat bottom surface and an upwardly facing top surface, the width of the body unit between the side surfaces thereof being at least approximately equal to the width of the torso of a patient to be supported on the body unit in a prone position, one of the end portions of the body unit being provided with a pair of upright, inclined surfaces extending between a respective side surface and the end surface of said one end portion of the body and which converge as the end surface of said one end portion of the body unit is approached for accommodating the axilla areas of a patient while the patient is supported on the body unit, a pair of elongated, parallel, spaced, transversely polygonal torso support sections extending along the length of the base section and projecting upwardly from the top surface of the base unit, each of the sections having a longitudinally extending outer side wall, a top wall, an inner wall projecting upwardly from the top surface of the base section, and a chamfered surface extending downwardly from a respective top wall to a corresponding inner wall in spaced relationship to the top surface of the base section, said chamfered surfaces cooperating to position and cradle the torso area of a patient supported on the base unit, the inner walls of the sections being of a height and in spaced relationship such that in cooperation with the top surface of the base section the inner walls and said top surface present an open top channel extending the length of the body unit of a size sufficient to alleviate significant interference with return venous blood flow through the torso of a patient supported in a prone position on the body unit.

2. A surgical pillow as set forth in claim 1, wherein said inner walls of the sections are spaced apart a distance approximately equal to the width of a respective chamfered surface.

3. A surgical pillow as set forth in claim 1, wherein said chamfered surfaces are at an angle of approximately 45° with respect to said top surface of the base section.

4. A surgical pillow as set forth in claim 1, wherein said body unit is of foam material.

5. A surgical pillow as set forth in claim 1, wherein is provided a cover over the body unit, said cover substantially conforming to the outer surface configuration of the body unit.

6. A surgical pillow as set forth in claim 1, wherein the opposed inner walls of said sections and the top wall of the base section cooperate to present a substantially U-shaped channel extending along the longitudinal length of the body unit.

7. A surgical pillow as set forth in claim 6, wherein said channel is of a depth approximately equal to the vertical height of a respective chamfered surface.

8. A surgical pillow as set forth in claim 6, wherein said channel is of a width approximately to the horizontal width of a respective chamfered surface.

9. A surgical pillow as set forth in claim 6, wherein the top wall of the sections is of a width approximately equal to the horizontal width of said channel.

10. A surgical pillow as set forth in claim 1, wherein said body unit is of one-piece monolithic construction.

11. An improved surgical pillow for supporting and cushioning a patient's body while the patient is in a prone position on an operating table during rectal surgery, said pillow comprising:

an elongated, self-sustaining, flexible, compressible body unit, said body unit being provided with an indented upper face defined by a longitudinally extending, centrally located channel, and chamfered, downwardly inclined surfaces on opposite sides of the central channel, said channel being of width and depth dimensions sufficient to alleviate significant interference with return venous blood flow through the torso of a patient supported in a prone position on the body unit, said body unit further being provided with a pair of inclined, upright, horizontally spaced, generally converging side surfaces disposed to accommodate the axilla areas of a patient while the patient is supported on the body unit.

12. A surgical pillow as set forth in claim 11, wherein said body unit is provided with generally horizontal, essentially parallel top walls extending in opposite directions away from the upper outermost margins of the chamfered surfaces.

13. A surgical pillow as set forth in claim 11, wherein said body unit is provided with a removable outer cover in general conforming relationship to the outermost surface of the body unit.

14. A surgical pillow as set forth in claim 11, wherein said channel is of a depth approximately equal to the thickness of the body unit.

15. A surgical pillow as set forth in claim 11, wherein said channel is of a width approximately one-fourth of the width of the body unit.

16. A surgical pillow as set forth in claim 11, wherein said channel is of a width approximately equal to the width of each of the chamfered surfaces.

17. A surgical pillow as set forth in claim 11, wherein said body unit is of one-piece, monolithic construction.

* * * * *